US009546831B2

(12) United States Patent
Bandini et al.

(10) Patent No.: US 9,546,831 B2
(45) Date of Patent: Jan. 17, 2017

(54) HANDGUN WITH A LOCKING DEVICE

(75) Inventors: Nicola Bandini, Road Town (VG); Dimitry Streshinskiy, Road Town (VG)

(73) Assignee: Arsenal Firearms Finance Limited (VG)

( * ) Notice: Subject to any disclaimer, the term of this patent is extended or adjusted under 35 U.S.C. 154(b) by 0 days.

(21) Appl. No.: 13/818,144

(22) PCT Filed: Sep. 14, 2012

(86) PCT No.: PCT/IB2012/054822

§ 371 (c)(1),
(2), (4) Date: May 9, 2013

(87) PCT Pub. No.: WO2013/014656

PCT Pub. Date: Jan. 31, 2013

(65) Prior Publication Data

US 2014/0196337 A1 Jul. 17, 2014

(30) Foreign Application Priority Data

Sep. 20, 2011 (WO) ..... PCT/IB2011/054123

(51) Int. Cl.
*F41A 3/78* (2006.01)
*F41A 3/44* (2006.01)
*F41A 5/02* (2006.01)

(52) U.S. Cl.
CPC .. *F41A 3/78* (2013.01); *F41A 3/44* (2013.01); *F41A 5/02* (2013.01)

(58) Field of Classification Search
CPC ..... F41A 3/78; F41A 3/44; F41A 5/02
(Continued)

(56) References Cited

U.S. PATENT DOCUMENTS 1,427,966 A * 9/1922 Nickl ..... 89/163
1,563,675 A * 12/1925 Tansley ..... 89/128
(Continued)

FOREIGN PATENT DOCUMENTS

| | | |
|---|---|---|
| DE | 29704123 U1 | 8/1997 |
| DE | 19645681 A1 | 5/1998 |
| GB | 673028 | 5/1952 |

OTHER PUBLICATIONS

International Search Report issued in corresponding International Patent Application No. PCT/IB2012/054822 dated Jan. 7, 2013 (3 pages).

*Primary Examiner* — Joshua Freeman
(74) *Attorney, Agent, or Firm* — Kilyk & Bowersox, P.L.L.C.

(57) ABSTRACT

The present invention relates to a gun (1) with a barrel (4) which proximally delimits a firing chamber (6), and a slide (8) translatable between a forward configuration in which it closes the firing chamber (6), and a rearward configuration in which it is distanced from the barrel (4) to open said chamber (6). The orientation of the firing chamber (6) in the forward configuration and in the rearward configuration is substantially parallel to the longitudinal axis (X). The gun (1) further comprises a locking device (10), which in the forward configuration acts so as to join the barrel (4) and the slide (8) and in the rearward configuration releases the slide (8) to enable its backward movement. The locking device (10) comprises at least one locking projection (12, 14) which, when the slide (8) and the barrel (4) are reciprocally released, guides the slide (8) in translation.

21 Claims, 5 Drawing Sheets

(58) Field of Classification Search
USPC ..... 89/163, 164, 138, 180, 194–197
See application file for complete search history.

(56) References Cited

U.S. PATENT DOCUMENTS

| | | | | | |
|---|---|---|---|---|---|
| 3,241,449 | A | * | 3/1966 | Dwyer, Sr. | 89/196 |
| 3,435,727 | A | * | 4/1969 | Miller et al. | 89/163 |
| 4,173,169 | A | * | 11/1979 | Yates et al. | 89/132 |
| 4,176,584 | A | * | 12/1979 | Thomas et al. | 89/138 |
| 4,201,113 | A | * | 5/1980 | Seecamp | 89/199 |
| 4,485,723 | A | * | 12/1984 | Sarony | 89/163 |
| 4,854,217 | A | * | 8/1989 | Ransom | 89/163 |
| 4,915,011 | A | * | 4/1990 | Smith | 89/176 |
| 4,916,843 | A | * | 4/1990 | Beretta | 42/70.01 |
| 5,259,138 | A | * | 11/1993 | Scirica | 42/70.08 |
| 5,275,084 | A | * | 1/1994 | Ruger | 89/196 |
| 5,433,134 | A | * | 7/1995 | Leiter | 89/14.5 |
| 5,581,046 | A | * | 12/1996 | Weldle et al. | 89/196 |
| 5,753,848 | A | * | 5/1998 | Kart | 89/16 |
| 5,808,229 | A | * | 9/1998 | Bastian et al. | 89/163 |
| 6,234,059 | B1 | * | 5/2001 | Fuchs et al. | 89/196 |
| 6,415,702 | B1 | * | 7/2002 | Szabo et al. | 89/148 |
| 6,442,882 | B1 | * | 9/2002 | Dionne | 42/77 |
| 7,340,987 | B1 | * | 3/2008 | Williams | 89/196 |
| 7,571,672 | B1 | * | 8/2009 | Williams | 89/196 |
| 7,673,553 | B2 | * | 3/2010 | Lippard | 89/196 |
| 7,861,640 | B2 | * | 1/2011 | Lippard | 89/196 |
| 8,752,474 | B2 | * | 6/2014 | Vanek | 89/198 |
| 2005/0257413 | A1 | * | 11/2005 | Zimmermann | 42/75.1 |
| 2008/0034955 | A1 | * | 2/2008 | McGarry | 89/196 |
| 2011/0185885 | A1 | * | 8/2011 | Zimmerman | 89/125 |

* cited by examiner

HANDGUN WITH A LOCKING DEVICE

This application is a National Stage Application of International Patent Application No.

PCT/IB2012/054822, filed Sep. 14, 2012, which claims priority to International Patent Application No. PCT/IB2011/054123, filed Sep. 20, 2011.

FIELD OF INVENTION

The present invention relates to a gun, preferably of the (semi-)automatic type.

BACKGROUND OF INVENTION

Various types of guns are known in the art; among these, one specific category consists of the so-called "short recoil" guns.

Briefly, during the initial stages of firing, the bolt and the barrel recoil simultaneously for a stroke of several millimeters, thereby keeping the firing chamber locked. Subsequently, a proximal portion of the barrel is made to deviate by various expedients from the common stroke with the bolt to enable the latter to open the chamber and reload it with a new cartridge. Among the known locking systems one could mention, merely by way of example, the Browning, Glock or Sig-Sauer geometric type locks.

However, the known locks have the drawback that after an elevated number of firing cycles, the geometric coupling precision of the barrel, slide and components used to deviate the barrel, tends to rapidly decrease.

Moreover, from document DE19645681A1 a gun fitted with a transversal bar is known of which in a first functioning configuration of the firearm locks the barrel to the slide, and which in a second configuration releases the slide so as to allow its further rearward movement in relation to the barrel and to the gun frame.

However such earlier system also presents a variety of drawbacks. In particular, the oblique abutments acting between the transversal bar and the gun frame to block and to release the slide do not constitute a reliable technical solution, especially in quick fire, in that the transition of such bar between the described configurations is sudden and violent, subjecting said component to repeated stress. Moreover, the transversal bar remains totally inactive during the independent slide excursion, because it is released from the barrel in such a way as to completely insert itself in a special housing performed in the frame.

Besides, in the aforesaid earlier gun, the longitudinal translation of the slide is guided in an extremely imprecise manner; in fact, such movement is conducted by means of narrow contact areas of the slide on the barrel and on the frame, so that gliding of the slide does not remain accurately repeatable for a high number of cycles.

Lastly, in earlier documents DE29704123U1, U.S. Pat. No. 5,808,229A, GB673028A and U.S. Pat. No. 4,854,217A firearms with a tipping barrel are shown, which therefore envisage an inclination or lowering of the respective firing chambers during the various firing steps, and which are evidently lacking supplementary guide systems of the barrel in relation to the gun frame.

SUMMARY OF INVENTION

For such reason, the present gun with its locking system sets out to resolve the aforementioned problems, in particular by supplying a device in which the kinematisms are shaped so as to suffer a reduced level of wear, which do not need high production tolerance and which present a repeatability and firing precision without equal in the current state of the art.

Such objective is achieved by a gun according to claim 1, and according to claims 8, 9, 10 and 11. The dependent claims show preferred embodiment variations.

BRIEF DESCRIPTION OF DRAWINGS

The present invention will now be described in detail, with the help of the attached drawings, wherein.

DETAILED DESCRIPTION

Figure 1:
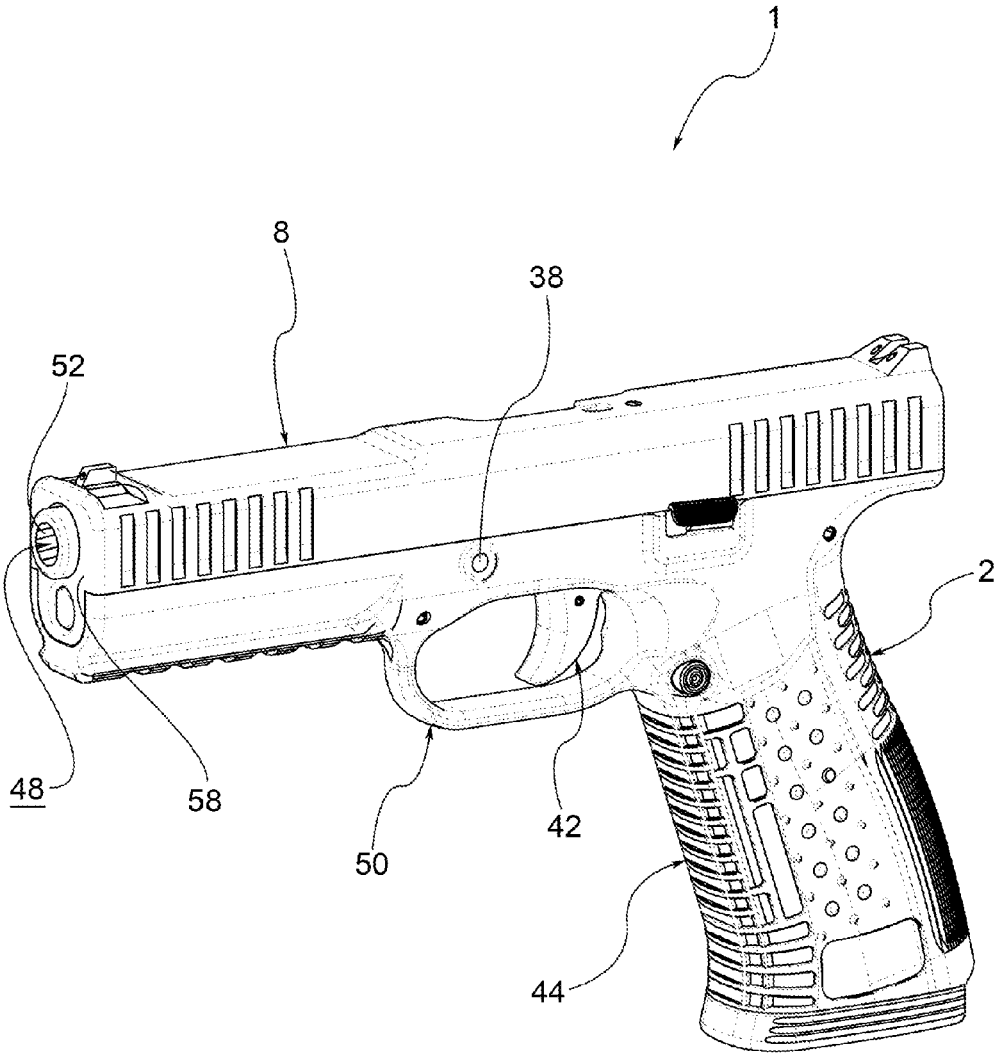
FIG. 1 shows a perspective view of the gun which the present invention relates to according to one embodiment.
Figure 2A:
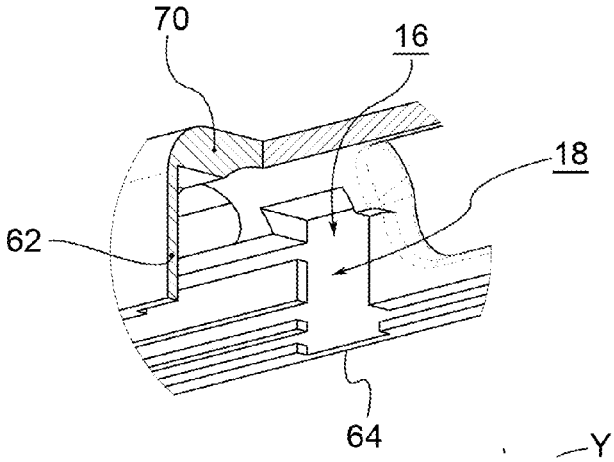
FIG. 2*a* shows an enlargement of the area marked in FIG. 2.
Figure 2:
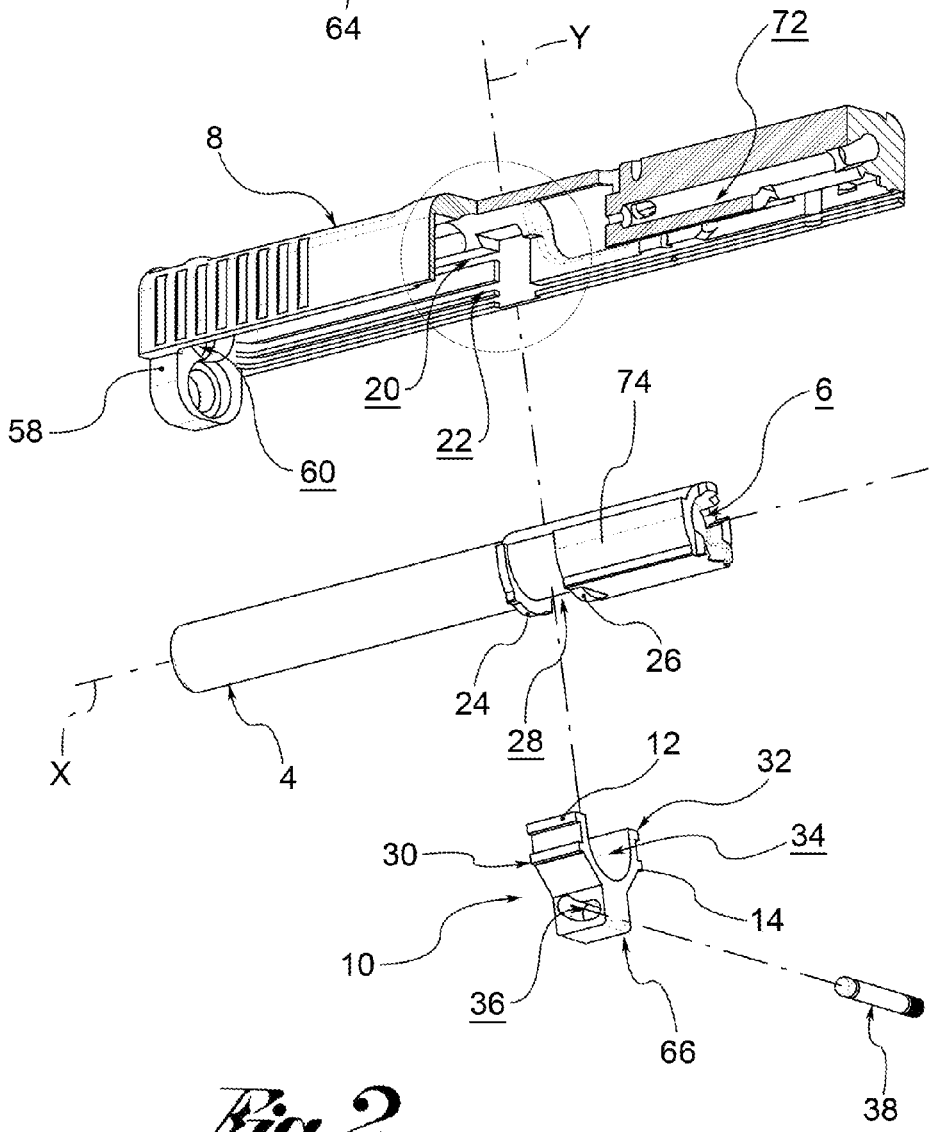
FIG. 2 shows an exploded, perspective view of the locking system which the present invention relates to, according to a possible variant, used in the gun in FIG. 1.

With reference to the aforesaid drawings, reference numeral 1 globally denotes a gun. Preferably, such gun is a semi-automatic, advantageously short recoil, gun.

According to a particularly advantageous variant, such gun is of the automatic type, therefore suitable for firing volleys of bullets. For example, the gun 1 may comprise a selector (not shown; for example positioned on the gun frame 2 described below), suitable for switching the functioning of the firearm from semi-automatic to automatic and vice versa.

The gun 1 comprises a gun frame 2 and a barrel 4, supported by the gun frame 2, advantageously in a movable manner so as to allow the barrel to recoil.

According to one embodiment illustrated in the drawings, the gun 1 comprises a trigger 42 mounted to the frame 2 in a rotatable manner. A further variant envisages that the trigger 42 is connected in a translatable manner to such frame.

In a further embodiment, the gun frame 2 comprises a grip or grippable portion 44, preferably ergonomically shaped in relation to a user's hand.

In yet a further variant, the gun frame 2 comprises a support wall 46, connected to the grippable portion 44 and which extends distally from it.

Within this patent specification, the term "proximal" will be taken to mean the components of the gun positioned near or towards the grippable portion 44; vice versa, the term "distal" will be used to indicate the components positioned towards a muzzle 48 of the weapon.

Again according to the variation shown, the gun frame 2 comprises a trigger guard 50 which extends from the support wall 46 to the grippable portion 44, advantageously made in one piece with the aforesaid wall 46 and the aforementioned portion 44.

As regards the structure of the barrel 4, proximally it has a firing chamber 6, which extends along a longitudinal axis X, suitable for at least partially housing a cartridge. Preferably, the barrel opens distally towards the muzzle 48, and advantageously has an internal rifling 52, for example clockwise or anti-clockwise oriented.

For the variants envisaging a support wall 46, such wall extends substantially parallel to the longitudinal axis X.

The gun further comprises a slide 8, moving longitudinally in relation to the gun frame 2 between a forward configuration in which the slide closes the firing chamber 6, and a rearward configuration in which it is distanced from the barrel 4 to open the aforementioned chamber 6.

Figure 7:
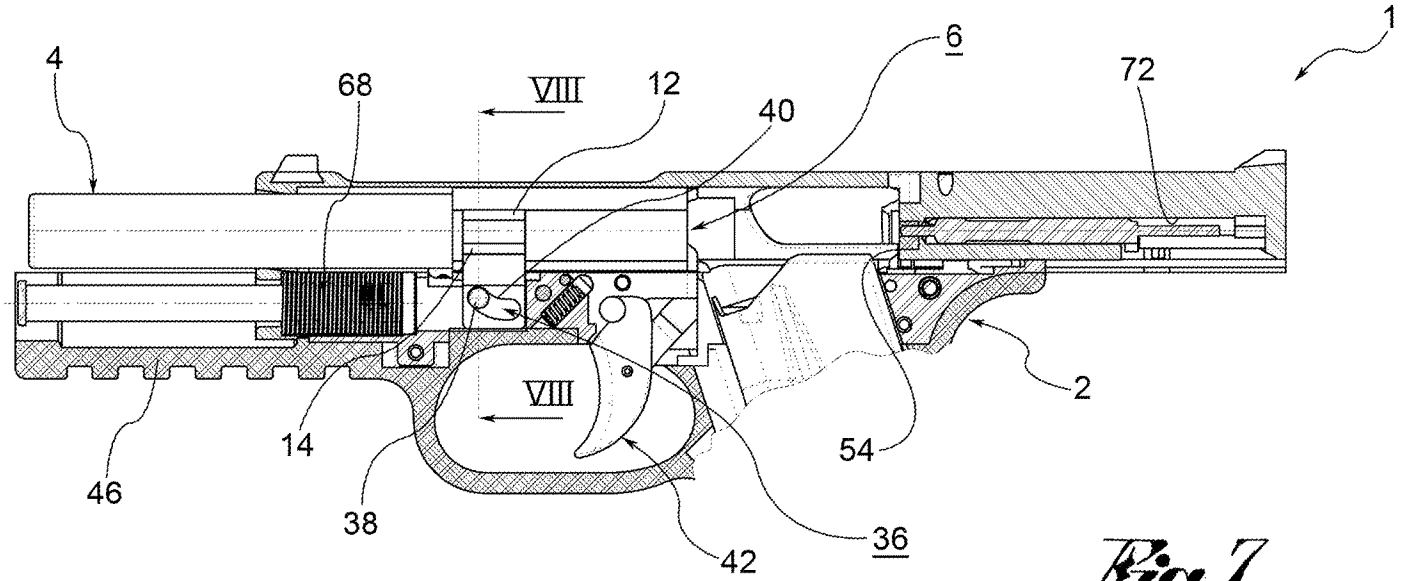

Consequently, in the forward configuration, the slide 8 acts in conjunction with the barrel 4 to occlude the firing chamber 6; in particular, in such configuration an inner wall 54 of the slide 8 at least partially overlaps the proximal opening of the chamber. Conversely, in the rearward configuration (as shown in FIG. 7), the slide moves on the frame 2 proximally to the forward configuration, so that the inner wall 54 positions itself at a certain distance from the mouth of the firing chamber 6; in this configuration, the firing chamber is open.

Preferably, at least one among the gun frame, slide and barrel is made of a plastic material. Advantageously, all such components are polymeric.

The orientation of the firing chamber 6 in the forward configuration and in the rearward configuration is substantially parallel to the longitudinal axis X. In other words, when the barrel undergoes the recoil produced by the shot, it translates for a brief stroke, joined to the slide 8, conserving its orientation; this way, at each firing phase the barrel remains straight and in line, and any inclination or tipping thereof is avoided.

Preferably, in the previous forward and rearward configurations, the orientation of the barrel is substantially coincident with the longitudinal axis X.

According to an extremely advantageous variant, the barrel 4 has externally at least one sliding guide 74, preferably substantially planar or rounded, facing and acting in conjunction with an inner surface of the slide 8; this way the aforesaid orientation and perfect alignment of the barrel is ensured, in that the slide accompanies the latter during the recoil or, conversely, the barrel 4 acts as a guide for the further proximal translation of the slide 8, in particular after the barrel and slide have been reciprocally released. According to the embodiment shown, the sliding guide 74 is positioned so as to at least partially overlap the firing chamber 6.

Preferably, the sliding guide faces the wall 70 defining the slide at the top; according to one variant a plurality of sliding guides are provided, positioned above or laterally.

According to one embodiment variation, the gun 1 comprises a firing pin 56 movable towards the firing chamber 6 by means of a firing device activated by the trigger 42.

In the embodiment shown, the firing device is a floating firing pin. A further variation, envisages that the firing pin is activated by a hammer mounted in a rotatable manner on the gun frame 2.

Advantageously, the firing pin 56 is housed so as to be movable longitudinally in a seat 72 performed proximally in the slide 8. According to one variation, the firing pin 56 crosses the inner wall 54 of the slide 8, thereby projecting towards the firing chamber 6.

Preferably, the slide 8 is mounted in a slidable manner on the barrel 4, in particular parallel to the longitudinal axis X. For example, a distal wall 58 of the slide 8 is traversed by a barrel hole 60 engaged by the barrel in a translatable manner.

The gun 1 further comprises a locking device 10, which in the forward configuration acts so as to join the barrel 4 and the slide 8, and in the rearward configuration releases the slide 8 to enable its backward movement.

Consequently, in the forward configuration, the locking device 10 blocks the barrel and the slide so that these move in synchrony; nevertheless, in the rearward configuration, such device 10 releases the slide so that it can continue its rearward movement, independently of the barrel 4, to open the firing chamber 6.

Preferably, in the rearward configuration, the locking device 10 is further away from the longitudinal axis X than in the forward configuration. In other words, by means of the aforementioned distancing from axis X, the locking device 10 releases the slide 8.

Preferably, the locking device 10 is connected to the gun frame 2 so as to be conducted in a radial direction Y, for example along an arched trajectory. In particular, one variant envisages that the entire device 10 moves in such direction of translational movement. As a result, the locking device 10 is joined to the aforesaid frame 2 so as to follow the preferably arched trajectory between said configurations. Advantageously the arched trajectory is realised by means of a sliding slot hole 36, performed in the locking device 10, having a curved profile.

According to a preferred embodiment, the locking device 10 is joined in translation to the barrel 4, although with freedom of movement in a radial direction Y.

Advantageously, the locking device 10 is engaged with the barrel 4 distally to the firing chamber 6, preferably in a position between the aforesaid chamber and the muzzle 48.

According to a further embodiment, the locking device 10 at least partially overlaps the firing chamber 6.

According to yet a further embodiment, the locking device 10 interacts with the barrel 4 distally to the trigger 42.

According to one variation, the locking device 10 comprises at least a locking projection 12, 14 which, in the forward configuration, engages a locking seat 16, 18 of the slide 8.

Consequently, as long as the locking projection 12, 14 is positioned in the locking seat 16, 18, the device 10 cannot be moved in relation to the slide; equally, since one variant envisages that such organ is joined in translation with the barrel, in such configuration the barrel too is joined to the slide.

Preferably, the locking device 10 comprises at least one locking projection 12, 14 which, when the slide 8 and the barrel 4 are reciprocally released, acts as a translation guide for the slide 8.

This way, according to the last two variants, the locking projection is suitable for performing a dual function as a component of the lock and as a guide for the slide.

Preferably, a plurality of locking projections 12, 14 are provided so that they can work on opposite longitudinal walls 62, 64 of the slide; advantageously, such projections are arranged in pairs, the projections of each pair being preferably spaced out on the locking device 10 transversally to the main extension of the slide.

A further variant envisages that the longitudinal walls 62, 64 are connected to each other by means of the wall 70 so that, according to such variant, the projections 12, 14 are suitable for coupling with the slide 8 at the connection portion between the aforesaid walls 62, 64, 70.

One particularly preferred embodiment envisages that the locking projection 12, 14 (or plurality thereof) is engaged so as to slide along a longitudinal rifling 20, 22 of the slide 8.

In fact, according to an advantageous variant, at least one of the longitudinal walls 62, 64 of the slide 8 (preferably both) has a longitudinal rifling 20, 22 on the inside preferably a number of riflings equal to the number of locking projections 12, 14 which interact with the locking device 10.

Preferably, the locking seat 16, 18 and the longitudinal rifling 20, 22 are communicating. This way, when disconnected from the locking seat 16, 18 the locking projection 12, 14 inserts itself directly into the longitudinal rifling 20, 22.

According to an advantageous variant, the locking projection 12, 14 is a fin substantially parallel to the longitudinal axis X.

The use of a fin to form the projection has proven particularly advantageous, in that such conformation provides a sufficiently broad longitudinal surface to guide the slide reliably in a rectilinear manner, and to be extremely resistant for locking the slide.

One embodiment of the barrel 4 envisages that it comprises at least one abutment protrusion 24, 26 which extends radially (in relation to the axis X) from its outer surface, so as to influence the locking device 10.

Figure 4:
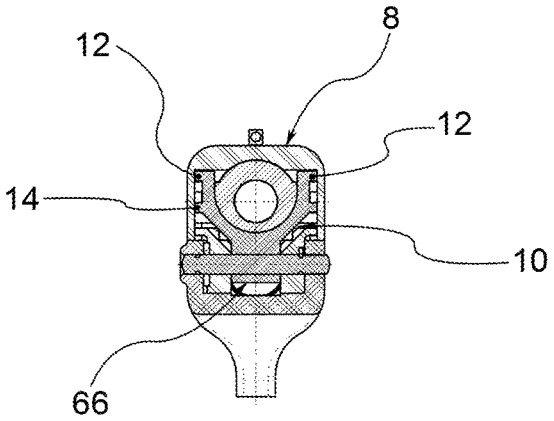
FIGS. 4, 6 and 8 are transversal cross-sections corresponding to the functioning phases of FIGS. 3, 5 and 7, along the lines IV-IV, VI-VI and VII-VII of such figures.

As shown for example in FIG. 4, the tubular body of the barrel 4 has the abutment protrusion 24, 26 proximally, for example in the form of a lip, which forms an abutment for the locking device 10.

Preferably, a pair of abutment protrusions 24, 26 are provided axially distanced to define a seat 28 to house such device 10 in a sliding manner. This way, the abutment device 24, 26 is bi-laterally retained during the phases of barrel recoiling.

So, preferably, the seat 28 identified by the barrel 4 for housing the locking device 10 in a sliding manner is positioned distally in relation to the firing chamber 6 and, advantageously, also in relation to the trigger 42.

According to one particularly advantageous embodiment, the locking device 10 comprises a first 30 and a second 32 arm which define between them a recess 34 to house a section, e.g. a proximal section, of the barrel 4.

In other words, the aforesaid arms 30, 32 extend from the body of the locking device so as to delimit the recess 34 in which the barrel is positioned.

Figure 6:
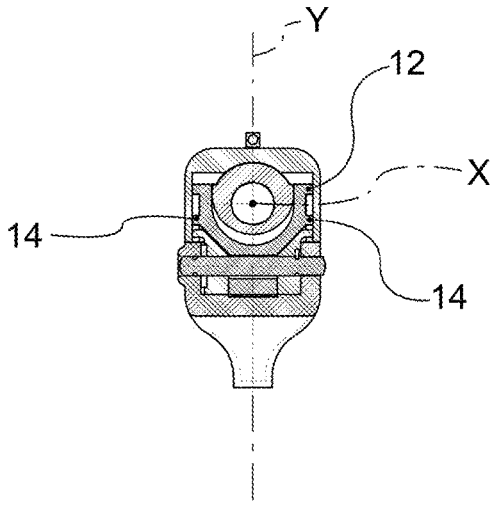
Figure 8:
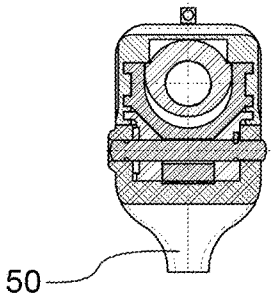

According to a preferred variant, the arms 30, 32 are of sufficient length to prevailingly contain the core of the barrel; within this context, the term "prevailingly" is understood to mean that the arms define a recess having a depth at least equal to 50% of the outer diameter of the barrel, preferably at least 65%, advantageously 75-80% or more. To such purpose reference may be made for example to the drawings in FIG. 6 or 8.

Preferably, the arms 30, 32 are divergent, so that the body of the locking device 10 assumes a generally "Y"-shaped conformation, with a lower appendage 66 from which the arms depart.

Even more preferably, the locking projection 12, 14 is positioned on at least one of said arms 30, 32, preferably at their free ends.

For the variants which envisage a plurality of the aforesaid projections 12, 14, advantageously these are positioned in pairs on each arm 30, 32. For example, a first projection 12 of the pair occupies the free end of the respective arm, while the other 14 an intermediate portion of such arm.

One particularly advantageous variant envisages that the distance of the projections of each pair is such as to include the longitudinal axis X between them. In other words, with reference to FIGS. 4 and 6, the pair of projections denoted by number 12 lies above such axis X in an axial view, while the pair of projections denoted by number 14 lies below such axis. Consequently, the core of the barrel is firmly retained. Preferably, such bilateral retention is maintained throughout all the phases of functioning of the firearm.

According to one variation, guide means made in the locking device 10 and in the gun frame 2 are provided for switching/conversion between the configurations described. Preferably, the guide means comprise sliding slot 36, which crosses at least partially the locking device 10, and a movement lug, joined to the frame 2, housed so as to slide in the sliding slot 36.

So, this variant envisages that the distancing of the locking device from the axis X is substantially equal to the distance between the vertexes defining the slot.

Advantageously, the sliding slot 36 traverses the locking device 10 completely and, more specifically, traverses the thickness of the lower appendage 66.

According to a particularly preferred variation, the sliding slot 36 has a curved profile, advantageously with a concavity 40 facing the barrel 4, and in particular the firing chamber 6.

Advantageously, the movement lug 38 is composed of a pin releasing the slide 8 from the gun frame 2.

Consequently, according to such variant, the release pin can be disengaged from the gun frame 2 to dismantle the weapon.

Merely by way of example, the functioning of the gun described will now be illustrated.

Figure 3:
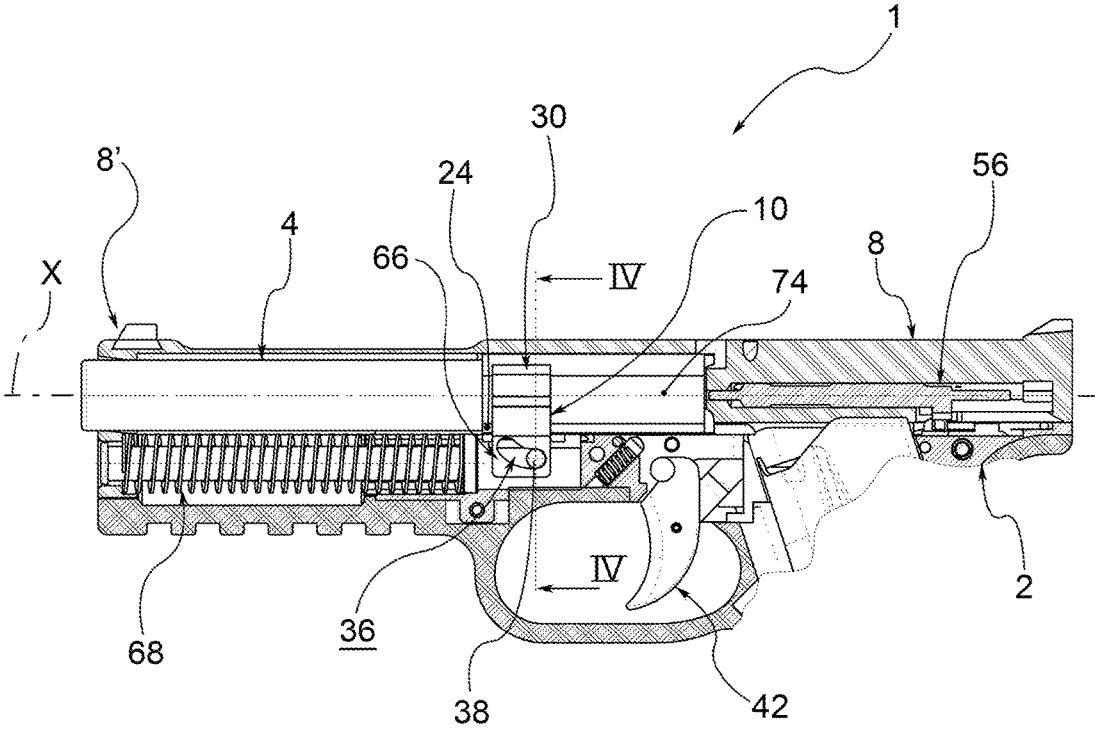
FIGS. 3, 5 and 7 show side views partially in cross section of the gun in FIG. 1, during various firing phases of the weapon.

In an initial phase, a cartridge (not shown) is found to be inserted in the firing chamber 6 and the relative position of the gun frame 2, the barrel 4 and the slide 8 is as shown in FIG. 3: the distal end of the slide 8' is substantially aligned with the free portion of the support wall 46 and is kept in such position by the action of a recovery spring 68, sliding in a seat obtained between the barrel 4 and the gun frame 2, which is in an extended configuration.

The barrel 4 and the slide 8 are joined by the locking device 10 in that the latter, adjacent to the longitudinal axis X, occupies the seat 28 housing the barrel and stops the slide 8 by means of the geometric coupling of the locking projections 12, 14 and the locking seats 16, 18.

In addition, initially, the movement lug 38 is positioned at the proximal vertex of the sliding slot 36.

Figure 5:
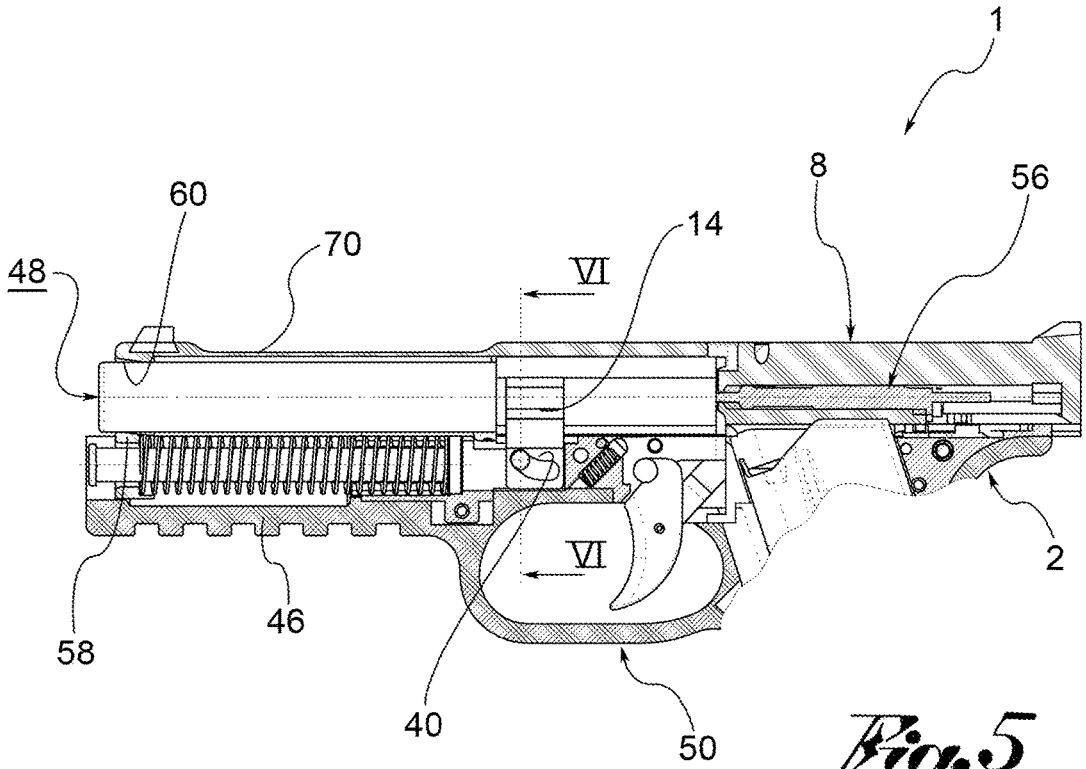

When the trigger 42 is pulled, the firing device moves the firing pin 56 towards the firing chamber 6, so as to strike the fuse of the cartridge therein inserted and to cause the explosion. By way of reaction a bullet comes out distally from the muzzle 48, and the barrel, locking device and slide group recoil for a certain distance. As may be seen, for example, in FIG. 5, the distal end of the slide 8' is rearwardly moved in relation to the free portion of the support wall 46, and the barrel 4 too is proximally shifted in relation to the frame.

As a result of the combined movement of longitudinal translation of the barrel and the sliding of the movement lug 38 along the sliding slot 36, the locking device 10 is distanced radially from the longitudinal axis X. In fact, the locking device 10 moves in relation to the movement lug 38 (the latter integral with the gun frame 2) in a radial direction in relation to the axis X, by virtue of the co-operation between the sliding slot hole 36 and movement lug 38. When such lug 38 reaches the distal vertex of the sliding slot 36, the locking projections 12, 14 have come out of the locking seats 16, 18 and have aligned with the longitudinal riflings 20, 22 of the slide 8. This way, the slide is released from the barrel, which has reached an end stroke. The orientation of the firing chamber 6 rather has remained substantially coincident with the axis X, in that the distancing from such axis relates solely to the locking device.

Subsequently, given that the pressure inside the firing chamber is sufficiently high to overcome the recall force of the recovery spring 68, the slide continues its rearward movement starting aperture of the firing chamber. During such backward movement, the locking projections 12, 14 slide along the longitudinal riflings 20, 22 and therefore act as translation guides. The presence of four projections/tabs and of the same number of riflings makes this movement highly balanced and reproducible.

Lastly, when the pressure in the firing chamber falls below a predefined value such as to be overcome by the recall force of the recovery spring 68, which is compressed (FIG. 7), the slide inverts direction, pointing itself distally, restoring the configuration of the barrel and of the locking device existing in the starting position (FIG. 3). In such configuration, the gun is ready for a new firing cycle.

Innovatively the gun which the present invention relates to has an elevated coupling precision and reduced wear compared to prior art weapons.

Innovatively, the gun which the present invention relates to has precise, repeatable movements, and is therefore suitable for functioning for a high number of cycles.

In fact, the locking device described is suitable for stably guiding the barrel during its relative movement, and thus to conduct it in the firing phases of the gun. The performance of at least one additional guide element compared to those traditionally existing makes it possible to achieve a movement precision without equals and a surprising return accuracy to the battery line. In fact, the prior art devices suggest the use of tipping barrels which do not maintain the firing line (and thereby favour the phenomenon of muzzle jumping), or the use of a transversal bar which, as well as lacking any role during the independent movement of the slide, presents objective release difficulties from the barrel.

Advantageously, the gun which the present invention relates to is extremely well-balanced thereby maintaining a high level of shooting accuracy even in quick fire and even in firing volleys for some variants.

Advantageously, the gun which the present invention relates to allows a barrel core with mechanical or electronic targeting element borne on the slide, to be proposed. Consequently, such gun has an excellent internal, external and terminal ballistic trajectory.

Advantageously, the locking system described makes it possible to reduce the dimensions of the movement lug and in particular of the release pin, given its delicate and progressive features. In fact, by reducing the stress, the size of such component can be reduced. For example, such lug, preferably cylindrically symmetric, can be made with a maximum diameter of 4 millimeters.

Advantageously, in addition, the compact nature of the locking device and the relative position of the locking components make it possible to significantly reduce the distance between the longitudinal axis and the point closest to the user's hand along the grippable portion; preferably, such distance is 12 millimeters or less.

The consequent technical effect is enormous, since the centre of thrust of the barrel and centre of resistance of the hand come to be very close, and the gun nosing-up is substantially absent.

Consequently, the gun which the present invention relates to demonstrates a maximum speed of return to the battery line and therefore an elevated repeatability of firing in quick-fire, e.g. targeted.

Such effect is further intensified by the fact that the kinematisms of the firing device are staggered in relation to the locking device; consequently, on the one hand their mutual interaction is prevented and on the other the dimensions of the gun transversally to the longitudinal axis X can be extremely limited.

Advantageously, the gun which the present invention relates to is suitable for being produced in an extremely economical manner.

Lastly, advantageously, the loading of bullets inside the firing chamber takes place substantially along the longitudinal axis; consequently, inside the magazine the bullets do not need to be kept with their ogives pointing upwards as in the prior art. On the contrary, such bullets penetrate the chamber substantially without interacting with the frame and/or with the mouth of the firing chamber. This makes it possible to avoid scraping during said insertion and therefore makes the present gun more reliable than the traditional weapons.

A person skilled in the art may make variations to the embodiments of the gun described above or replace elements with others functionally equivalent so as to satisfy specific requirements.

For example, one embodiment (not shown) envisages that the locking device is fitted with a movement lug and that the corresponding sliding slot hole is rather made in the gun frame so as to allow the movement of such device.

Such variations are also contained within the sphere of protection as defined by the following claims.

Moreover, each of the variants described as belonging to a possible embodiment may be realised independently of the other variants described.

The invention claimed is:

1. Gun comprising:

a gun frame;

a barrel, supported by the gun frame, which proximally delimits a firing chamber extending along a longitudinal axis;

a slide, translatable longitudinally in relation to the gun frame between a forward configuration in which the slide closes the firing chamber, and a rearward configuration is which it is distanced from the barrel to open said chamber, and a locking device, which in the forward configuration is suitable for joining the barrel and the slide and which in the rearward configuration is suitable for releasing the slide to enable its backward movement;

the orientation of the firing chamber in the forward configuration and in the rearward configuration being substantially parallel to said axis; and said gun being characterised by a locking device comprising at least one locking projection which, when the slide and the barrel are reciprocally released, guides the slide in translation.

2. Gun according to claim 1, wherein the locking projection is engaged in a slidable manner along a longitudinal slot of the slide.

3. Gun according to claim 1, wherein the locking device comprises a first and a second arm which define between them a recess for housing a section of the barrel.

4. Gun according to claim 3, wherein the locking projection is positioned on at least one of said arms.

5. Gun according to claim 1, comprising a plurality of locking projections in the form of tabs substantially parallel to the longitudinal axis, which work on opposite longitudinal walls of the slide.

6. Gun according to claim 1, wherein the locking device is joined to the gun frame so as to follow an arched trajectory between said configurations.

7. Gun according to claim 1, wherein the locking device is engaged with the barrel distally to the firing chamber.

8. Gun according to claim 1, wherein the at least one locking projection, in the forward configuration, engages a locking seat of the slide, and which in the rearward configuration slides along a longitudinal slot of the slide, the locking seat and the longitudinal slot being communicating.

9. Gun according to claim 1, wherein the barrel comprises a pair of abutment protrusions, extending radially from its own outer surface to act on the locking device, said protrusions being axially distanced to define a seat for housing said device in a slidable manner.

10. Gun according to claim 1, comprising guide means made in the locking device and in the gun frame for switching between said configurations, said means comprising a sliding slot hole which traverses at least partially the locking device and a movement lug, joined to said frame, housed so as to slide in said slot hole.

11. Gun according to claim 10, wherein the movement lug is composed of a pin releasing the slide from the gun frame.

12. Gun comprising:

a gun frame;

a barrel, supported by the gun frame, which proximally delimits a firing chamber extending along a longitudinal axis;

a slide, translatable longitudinally in relation to the gun frame between a forward configuration in which it closes the firing chamber, and a rearward configuration in which it is distanced from the barrel to open said chamber; and a locking device, which in the forward configuration is suitable for joining the barrel and the slide and in the rearward configuration is suitable for releasing the slide to enable its backward movement; the orientation of the firing chamber in the forward configuration and in the rearward configuration being substantially parallel to said axis;

said gun being characterised by a locking device engaged with the barrel distally to the firing chamber.

13. Gun according to claim 12, wherein the locking device comprises at least one locking projection which, in the forward configuration, engages a locking seat of the slide, and which in the rearward configuration slides along a longitudinal slot of the slide, the locking seat and the longitudinal slot being communicating.

14. Gun according to claim 12, wherein the barrel comprises a pair of abutment protrusions, extending radially from its own outer surface to act on the locking device, said protrusions being axially distanced to define a seat for housing said device in a slidable manner.

15. Gun according to claim 12, comprising guide means made in the locking device and in the gun frame for switching between said configurations, said means comprising a sliding slot hole which traverses at least partially the locking device and a movement lug, joined to said frame, housed so as to slide in said slot hole.

16. Gun according to claim 15, wherein the movement lug is composed of a pin releasing the slide from the gun frame.

17. Gun comprising:

a gun frame;

a barrel, supported by the gun frame, which proximally delimits a firing chamber extending along a longitudinal axis;

a slide, translatable longitudinally in relation to the gun frame between a forward configuration in which it closes the firing chamber, and a rearward configuration in which it is distanced from the barrel to open said chamber; and a locking device, which in the forward configuration is suitable for joining the barrel and the slide, and which in the rearward configuration is suitable for releasing the slide to enable its backward movement; the orientation of the firing chamber in the forward configuration and in the rearward configuration being substantially parallel to said axis;

said gun being characterised in that a locking device comprising a first and a second arm which define between them a recess for housing a section of the barrel.

18. Gun according to claim 17, wherein the locking device comprises at least one locking projection which, in the forward configuration, engages a locking seat of the slide, and which in the rearward configuration slides along a longitudinal slot of the slide, the locking seat and the longitudinal slot being communicating.

19. Gun according to claim 17, wherein the barrel comprises a pair of abutment protrusions, extending radially from its own outer surface to act on the locking device, said protrusions being axially distanced to define a seat for housing said device in a slidable manner.

20. Gun according to claim 17, comprising guide means made in the locking device and in the gun frame for switching between said configurations, said means comprising a sliding slot hole which traverses at least partially the locking device and a movement lug, joined to said frame, housed so as to slide in said slot hole.

21. Gun according to claim 20, wherein the movement lug is composed of a pin releasing the slide from the gun frame.

* * * * *